US012584225B1

(12) United States Patent
Nagamine et al.

(10) Patent No.: US 12,584,225 B1
(45) Date of Patent: Mar. 24, 2026

(54) RESIN MATERIAL TREATMENT METHOD, AND COMPOSITIONS FOR THE SAME

(71) Applicant: OKUNO CHEMICAL INDUSTRIES CO., LTD., Osaka (JP)

(72) Inventors: Shingo Nagamine, Osaka (JP); Koji Kita, Osaka (JP)

(73) Assignee: OKUNO CHEMICAL INDUSTRIES CO., LTD., Osaka (JP)

( * ) Notice: Subject to any disclaimer, the term of this patent is extended or adjusted under 35 U.S.C. 154(b) by 0 days.

(21) Appl. No.: 18/958,647

(22) Filed: Nov. 25, 2024

(51) Int. Cl.
*C23C 18/00* (2006.01)
*C23C 18/42* (2006.01)

(52) U.S. Cl.
CPC ..... *C23C 18/42* (2013.01)

(58) Field of Classification Search
CPC ..... C23C 18/42
USPC ..... 106/1.05
See application file for complete search history.

(56) References Cited

U.S. PATENT DOCUMENTS

| | | | |
|---|---|---|---|
| 3,671,274 | A | 6/1972 | Maekawa et al. |
| 3,867,174 | A | 2/1975 | Maekawa et al. |
| 4,001,372 | A | 1/1977 | Okabe et al. |
| 4,042,729 | A | 8/1977 | Polichette et al. |
| 4,145,527 | A | 3/1979 | Burns et al. |
| 4,443,257 | A | 4/1984 | Tomaiuolo et al. |
| 5,112,513 | A | 5/1992 | Bressel et al. |
| 6,861,097 | B1 | 3/2005 | Goosey et al. |
| 8,603,352 | B1 | 12/2013 | Zhang-Beglinger et al. |
| 9,023,228 | B2 | 5/2015 | Schildmann et al. |
| 9,267,077 | B2 | 2/2016 | Weitershaus et al. |
| 9,752,074 | B2 | 9/2017 | Schildmann et al. |
| 11,047,052 | B2 | 6/2021 | Nagamine et al. |
| 2004/0122115 | A1 | 6/2004 | Espinoza et al. |
| 2005/0123621 | A1 | 6/2005 | Burton et al. |
| 2007/0128366 | A1 | 6/2007 | Scaraglino et al. |
| 2011/0140035 | A1 | 6/2011 | Schildmann et al. |
| 2014/0306147 | A1 | 10/2014 | Weitershaus et al. |
| 2014/0329054 | A1 | 11/2014 | Theivanayagam Chairman et al. |
| 2015/0318067 | A1 | 11/2015 | Asano et al. |
| 2015/0344777 | A1 | 12/2015 | Nagamine et al. |
| 2016/0024381 | A1 | 1/2016 | Schildmann et al. |
| 2016/0102403 | A1 * | 4/2016 | Weitershaus ..... C23C 18/163 216/95 |
| 2017/0159183 | A1 | 6/2017 | Nagamine et al. |

FOREIGN PATENT DOCUMENTS

| | | | |
|---|---|---|---|
| CN | 106471156 | A | 3/2017 |
| EP | 913498 | A1 * | 5/1999 |
| JP | 2-97680 | A | 4/1990 |
| JP | 2007-154120 | A | 6/2007 |
| JP | 4198799 | B2 | 12/2008 |
| JP | 2009-228083 | A | 10/2009 |
| KR | 10-2010-0024620 | A | 3/2010 |
| KR | 10-2010-0072177 | A | 6/2010 |
| KR | 10-2014-0124341 | A | 10/2014 |
| WO | 2015/150156 | A1 | 10/2015 |

* cited by examiner

*Primary Examiner* — James E McDonough
(74) *Attorney, Agent, or Firm* — WHDA, LLP

(57) ABSTRACT

The present invention provides a pretreatment composition for electroless plating, a pretreatment method, and an electroless plating method that exhibit high plating deposition performance without using harmful chromic acid and expensive palladium, while reducing the number of steps. The present invention provides a pretreatment composition for electroless plating that contains 10 mg/L or more of manganese ions and 10 mg/L or more of monovalent silver ions.

11 Claims, No Drawings

RESIN MATERIAL TREATMENT METHOD, AND COMPOSITIONS FOR THE SAME

TECHNICAL FIELD

The present invention relates to a pretreatment composition for electroless plating, a pretreatment method for electroless plating, and an electroless plating method.

BACKGROUND ART

Molded resin articles have been used in automobile parts for the purpose of reducing the weight of automobiles, for example. Resins used for molded resin articles for this purpose include, for example, ABS resin, PC/ABS resin, PPE resin, and polyamide resin. Such molded resin articles are plated with copper, nickel, or other metals to add a luxurious appearance or aesthetic appeal. Additionally, a method for forming a plating film such as one of copper on a resin substrate has been performed in methods for forming a conductor circuit by imparting conductivity to such a resin substrate.

A typical method for forming a plating film on a resin material, such as a resin substrate or a molded resin article, includes performing etching treatment with chromic acid to roughen the surface of the resin material, optionally followed by neutralization and pre-dipping; adding an electroless plating catalyst using a colloid solution containing a tin compound and a palladium compound; performing activation treatment (accelerator treatment) for removing tin; and sequentially performing electroless plating and electroplating.

However, this method is harmful to the environment and the human body because of the use of chromic acid. This method also requires higher cost due to the use of expensive palladium for adding a catalyst. This method also involves many steps, because after the etching treatment step, a catalyst-adding step must be further performed separately.

There is suggested a method for forming a plating film on a resin material; the method includes bringing a part to be plated into contact with an aqueous solution containing a metal activator species to perform etching, bringing the part into contact with a solution of reducing agent capable of reducing the metal activator species, and bringing the part into contact with an electroless plating solution to perform metal plating (see PTL 1).

However, there is room to research in terms of the components of the activator species in the method according to PTL 1, and the formation of the plating film in PTL 1 is insufficient.

Thus, there is demand for the development of a pretreatment composition for electroless plating, a pretreatment method, and an electroless plating method that exhibit high plating deposition performance without using harmful chromic acid and expensive palladium, while reducing the number of steps.

CITATION LIST

Patent Literature

Patent Literature 1: U.S. Pat. No. 4,198,799

SUMMARY OF INVENTION

Technical Problem

The present invention has been made in view of the problems descried above. An object of the invention is to provide a pretreatment composition for electroless plating, a pretreatment method, and an electroless plating method that exhibit high plating deposition performance without using harmful chromic acid and expensive palladium, while reducing the number of steps.

Solution to Problem

The present inventors conducted extensive research to achieve the object, and found that a pretreatment composition for electroless plating that contains 10 mg/L or more of manganese ions and 10 mg/L or more of monovalent silver ions, a pretreatment method, and an electroless plating method can achieve the object. The inventors then completed the present invention.

Specifically, the present invention relates to the following pretreatment composition for electroless plating, pretreatment method, and electroless plating method.

1. A pretreatment composition for electroless plating, the composition comprising 10 mg/L or more of manganese ions and 10 mg/L or more of monovalent silver ions.
2. The pretreatment composition for electroless plating according to Item 1, wherein manganese of the manganese ions has a valence of 3 or more.
3. The pretreatment composition according to Item 1 or 2, which has a pH of 2 or less.
4. A pretreatment method for electroless plating for a resin material, the method comprising
   step 1: bringing the surface to be treated of the resin material into contact with a pretreatment composition, wherein the pretreatment composition contains 10 mg/L or more of manganese ions and 10 mg/L or more of monovalent silver ions.
5. An electroless plating method for a resin material, the method comprising
   (1) step 1: bringing the surface to be treated of the resin material into contact with a pretreatment composition, and
   (2) step 2: bringing the surface to be treated of the resin material into contact with an electroless plating solution, wherein the pretreatment composition contains 10 mg/L or more of manganese ions and 10 mg/L or more of monovalent silver ions.
6. The electroless plating method according to Item 5, wherein the electroless plating solution contains a reducing agent that is catalytically active on silver.

Advantageous Effects of Invention

The pretreatment composition for electroless plating according to the present invention can exhibit high plating deposition performance in electroless plating in the post-step without using harmful chromic acid and expensive palladium. The pretreatment composition for electroless plating according to the present invention also eliminates the need for separately performing an etching step and a catalyst-adding step, thus reducing the number of steps for performing electroless plating.

The pretreatment method for electroless plating according to the present invention makes it easy to treat the surface to be treated of a resin material, and reduces the number of pretreatment steps, because bringing the surface to be treated of the resin material into contact with the pretreatment composition enables the surface to be treated to be etched, while also adding a silver catalyst to the surface to be treated.

The electroless plating method according to the present invention makes it easy to treat the surface to be treated of a resin material and also reduces the number of steps for performing electroless plating, because bringing the surface to be treated of the resin material into contact with the pretreatment composition in the pretreatment step enables the surface to be treated to be etched, while also adding a silver catalyst to the surface to be treated, thus eliminating the need for a catalyst-adding step and an accelerator treatment step.

DESCRIPTION OF EMBODIMENTS

The following describes the present invention in more detail.

1. Pretreatment Composition for Electroless Plating

The pretreatment composition for electroless plating according to the present invention (simply "pretreatment composition" below) contains 10 mg/L or more of manganese ions and 10 mg/L or more of monovalent silver ions. Because the pretreatment composition according to the present invention contains a specific amount of manganese ions and a specific amount of monovalent silver ions, a reduction in etching power on the surface to be treated of a resin material is curbed, and the addition of a catalyst becomes sufficient.

For example, a pretreatment composition containing manganese ions and palladium ions, due to the presence of palladium ions, suffers a decrease in etching power of manganese ions. Additionally, a pretreatment composition containing chromic acid and silver ions generates a precipitate of silver chromate ($Ag_2CrO_4$), which is an insoluble precipitate, and this discharges silver ions out of the system, thereby resulting in insufficient addition of a catalyst.

In contrast, the pretreatment composition according to the present invention, due to the presence of manganese ions and monovalent silver ions, can form a plating film excellent in adhesion on the surface to be treated of a resin material by bringing the surface to be treated into contact with the pretreatment composition, and then bringing the surface to be treated into contact with an electroless plating solution.

The pretreatment composition according to the present invention, due to the presence of manganese ions and monovalent silver ions, also enables both etching of the surface to be treated of a resin substrate and addition of a catalyst simultaneously by bringing the surface to be treated into contact with the composition, thus making it possible to skip a catalyst-adding step.

Moreover, the pretreatment composition according to the present invention eliminates the need for using a palladium-tin colloid solution as in a traditional catalyst-adding step, and also makes it possible to skip the activation treatment (accelerator treatment) step for removing tin.

Specifically, the pretreatment composition according to the present invention can exhibit high plating deposition performance in electroless plating in the post-step without using harmful chromic acid and expensive palladium. The pretreatment composition for electroless plating according to the present invention also eliminates the need for separately performing an etching step and a catalyst-adding step and the need for performing an accelerator treatment step, thus substantially decreasing the steps for performing electroless plating.

Manganese Ions

Manganese ions are not particularly limited as long as they have oxidizing power. Manganese of manganese ions preferably has a valence of 3 or more, more preferably 4 or more, and still more preferably 7. For example, manganese ions contained in the pretreatment composition may be in the form of metal ions alone, such as trivalent manganese ions and quadrivalent manganese ions, or in the form of permanganate ions, which are septivalent manganese. Of these, from the standpoint of higher etching power, quadrivalent manganese ions and permanganate ions are preferable, and permanganate ions are more preferable. Manganese ions of divalent manganese have no oxidizing power, and the use thereof alone does not cause the surface of a resin material to be etched. However, such manganese ions may be used in combination with manganese ions of trivalent or higher manganese.

One kind of manganese ions may be used alone or two or more kinds of manganese ions may be used in combination.

Manganate for adding manganese ions to the pretreatment composition is not particularly limited, and includes manganese(II) sulfate, manganese(III) phosphate, manganese (IV) oxide, sodium permanganate(VII), and potassium permanganate(VII). Of these, from the standpoint of adding manganese ions that have higher etching power, manganese (III) phosphate, manganese(IV) oxide, sodium permanganate(VII), and potassium permanganate(VII) are preferable; and sodium permanganate(VII) and potassium permanganate(VII) are more preferable.

One kind of manganate may be used alone or two or more kinds of manganate may be used in combination.

The pretreatment composition according to the present invention contains manganese ions in an amount of 10 mg/L or more. An amount of manganese ions of less than 10 mg/L leads to insufficient etching of a resin material, reducing the adhesion of the film formed by electroless plating. The amount of manganese ions is preferably 10 mg/L to 100 g/L, more preferably 100 mg/L to 50 g/L, still more preferably 0.2 g/L to 30 g/L, particularly preferably 0.5 g/L to 15 g/L, and most preferably 0.5 g/L to 10 g/L. Setting the lower limit of the amount of manganese ions within these ranges further improves the etching power of the pretreatment composition. Setting the upper limit of the amount of manganese ions within these ranges further reduces the generation of the precipitate of manganese dioxide in the pretreatment composition and further improves bath stability.

Silver Ions

The silver ions contained in the pretreatment composition according to the present invention are monovalent silver ions. A silver salt for adding monovalent silver ions is not particularly limited as long as the silver salt can add monovalent silver ions that are stable in a bath when dissolved in the pretreatment composition, and as long as the counterions that form the silver salt do not have an adverse effect on manganese ions. Specifically, such silver salts include silver (I) sulfate, silver(I) nitrate, and silver(I) oxide. Of these, from the standpoint of high solubility and convenience in industrial application, silver(I) nitrate is preferable. Silver (I) sulfate is also preferable because silver(I) sulfate leads to higher deposition performance in plating and higher resistance to decreases in adhesion of the plating film even on resin materials formed of a resin such as an acrylonitrile-butadiene-styrene copolymer resin (ABS resin) or a polymer alloy of a styrene based-resin with a polycarbonate (PC) resin, on which it is hard to form a plating deposition.

One kind of such silver salts may be used alone or two or more kinds of silver salts may be used in combination.

The pretreatment composition according to the present invention contains monovalent silver ions in an amount of 10 mg/L or more. An amount of monovalent silver ions of less than 10 mg/L leads to insufficient deposition of electroless plating. The amount of monovalent silver ions is preferably 10 mg/L to 20 g/L, more preferably 50 mg/L to 15 g/L, and still more preferably 100 mg/L to 10 g/L. Setting the lower limit of the amount of monovalent silver ions within these ranges allows a sufficient amount of a silver catalyst to adsorb on the surface of a resin material and causes an electroless plating film to more sufficiently deposit on the surface. Although the amount of monovalent silver ions beyond the upper limits described above does not have an adverse effect, setting the upper limit as described above can reduce the amount of the silver salt for use, thereby decreasing cost.

Silver ions for use may be monovalent silver obtained by placing metal silver in an acidic manganese bath, and dissolving it. The acid for forming an acidic manganese bath is not particularly limited, and may be an inorganic acid or an organic sulfonic acid.

The inorganic acid includes sulfuric acid, phosphoric acid, nitric acid, hydrochloric acid, hydrofluoric acid, and boric acid. Of these, from the standpoint of excellence in effluent treatment, sulfuric acid is preferable.

The organic sulfonic acid includes $C_{1-5}$ aliphatic sulfonic acids, such as methanesulfonic acid, ethanesulfonic acid, propanesulfonic acid, and pentanesulfonic acid; and aromatic sulfonic acids, such as toluenesulfonic acid, pyridinesulfonic acid, and phenolsulfonic acid. Of these, from the standpoint of excellent bath stability of the pretreatment composition, $C_{1-5}$ aliphatic sulfonic acids are preferable.

One kind of such acids may be used alone or two or more kinds of acids may be used in combination.

The acid concentration of the pretreatment composition according to the present invention is not particularly limited; for example, the pretreatment composition has a total acid concentration of preferably 100 to 1800 g/L, and more preferably 800 to 1700 g/L.

Other Component

The pretreatment composition according to the present invention may contain a high-molecular compound in addition to the manganese ions and the silver ions. The type of the high-molecular compound is not particularly limited; from the standpoint of facilitating plating deposition, a cationic polymer may preferably be used. The amount of the high-molecular compound is preferably 0.01 to 100 g/L, and more preferably 0.1 to 10 g/L.

Solvent

The manganese ions, the silver ions, and optionally added other components of the pretreatment composition according to the present invention are preferably contained in a solvent. The solvent is not particularly limited, and includes water, an alcohol, and a mixture solvent of water and an alcohol.

The solvent is preferably water from the standpoint of its excellent safety. Specifically, the pretreatment composition according to the present invention is preferably an aqueous solution.

The alcohol is not particularly limited, and a known alcohol, such as ethanol, may be used.

A mixture solvent of water and an alcohol for use preferably has a low alcohol concentration. Specifically, the alcohol concentration is preferably about 1 to 30 mass %.

The pretreatment composition according to the present invention is preferably acidic. Due to the acidity of the pretreatment composition, etching treatment on a resin material is more sufficiently performed. The pretreatment composition according to the present invention preferably has a pH of 2 or less, and more preferably 1 or less.

2. Pretreatment Method for Electroless Plating for Resin Material

The pretreatment method for electroless plating for a resin material according to the present invention includes (step 1) bringing the surface to be treated of the resin material into contact with the pretreatment composition, and the pretreatment composition contains 10 mg/L or more of manganese ions and 10 mg/L or more of monovalent silver ions.

Step 1

Step 1 is a step of bringing the surface to be treated of the resin material into contact with the pretreatment composition.

The pretreatment composition for use may be the pretreatment composition for electroless plating described above.

The method for bringing the surface to be treated of a resin material into contact with the pretreatment composition is not particularly limited. The surface of a resin material may be brought into contact with the pretreatment composition by a known method. Such a method includes a method in which a resin material is immersed in a pretreatment composition, and a method in which the surface to be treated of a resin material is sprayed with a pretreatment composition. Of these, from the standpoint of higher contact efficiency, the method in which a resin material is immersed in a pretreatment composition is preferable.

The temperature of the pretreatment composition in step 1 is not particularly limited, and is preferably 30 to 100° C., more preferably 40 to 90° C., and still more preferably 50 to 80° C. Setting the lower limit of the temperature of the pretreatment composition within these ranges ensures more sufficient etching of the resin material surface and addition of a catalyst. Setting the upper limit of the temperature of the pretreatment composition within these ranges provides film appearance with much better decorativeness.

The contact time during which the pretreatment composition is in contact with the surface to be treated of a resin material in step 1 is preferably 3 to 60 minutes, more preferably 5 to 50 minutes, and still more preferably 10 to 40 minutes. Setting the lower limit of the contact time within these ranges ensures more sufficient etching of the resin material surface and addition of a catalyst. Setting the upper limit of the contact time within these ranges provides film appearance with much better decorativeness.

The use of a chromic acid-sulfuric acid mixture, which is related art, leads to immediate generation of a precipitate of silver chromate ($Ag_2CrO_4$) when monovalent silver ions are added to a bath; this makes it unable for silver to stably exist as ions in the pretreatment composition. Thus, when a chromic acid-sulfuric acid mixture, which is related art, is used, it is hard to use a pretreatment composition containing silver ions, unlike the present invention.

The resin for forming a resin material that is the object to be treated is not particularly limited. Resin materials for use may be a range of resin materials on which etching treatment is performed with an acid mixture of chromic acid and sulfuric acid. An excellent electroless plating film can be formed on such resin materials. Examples of the resin for forming a resin material include styrene based-resins, such as acrylonitrile-butadiene-styrene copolymer resin (ABS resin), a resin formed by replacing the butadiene rubber component of the ABS resin with an acrylic rubber component (AAS resin), and a resin formed by replacing the butadiene rubber component of the ABS resin with an ethylene-propylene rubber component (AES resin). A polymer alloy of such a styrene based-resin and polycarbonate (PC) resin (e.g., a polymer alloy with a PC resin content of about 30 to 70 mass %), or the like can also be preferably used. Additionally, usable resins include those excellent in heat resistance and physical properties, such as polyphenylene ether resins, polyphenylene oxide resins, polybutylene terephthalate (PBT) resins, polyphenylene sulfide (PPS) resins, and polyamide resins.

The resin material is not particularly limited in terms of shape, size, etc. The pretreatment method according to the present invention can also form a plating film excellent in decorativeness, physical properties and the like on large-size resin materials with a wide surface area. Such large-size resin materials include automotive associated parts, such as radiator grilles, hubcaps, small or medium emblems, and door handles; exterior trim items in the electrical and electronic field; faucet fittings used in the bathtub, sink, or basin area; and recreational-machine-associated items, such as Japanese pinball gaming parts.

In step 1 described above, the surface to be treated of a resin material is brought into contact with a pretreatment composition, and the surface to be treated is treated.

The pretreatment method according to the present invention may include degreasing treatment before step 1 in order to remove smudges from the surface to be treated of the resin material. The degreasing treatment is not particularly limited, and may be performed in accordance with a known method.

The pretreatment method according to the present invention may include, after step 1, a post-treatment that uses a post-treatment solution containing an inorganic acid in order to remove manganese adhered to the surface of the resin material.

The inorganic acid is not particularly limited, and examples include hydrochloric acid, sulfuric acid, nitric acid, phosphoric acid, hydrofluoric acid, and boric acid. Of these, from the standpoint of excellent manganese removability, hydrochloric acid is preferable.

One kind of such inorganic acids may be used alone or two or more kinds of inorganic acids may be used in combination.

The amount of the inorganic acid in the post-treatment solution is not particularly limited, and may be about 1 to 1000 g/L.

The post-treatment method is not particularly limited. For example, a resin material that has been pretreated by the pretreatment method may be immersed in the post-treatment solution with a liquid temperature of about 15 to 50° C. for about 1 to 10 minutes. This post-treatment can further improve the deposition performance and appearance of the formed plating film.

The pretreatment method for electroless plating for a resin material described above can etch the surface to be treated of a resin material, while also adding a silver catalyst to the surface to be treated, and exhibits high plating deposition performance in electroless plating in the post-step.

3. Electroless Plating Method for Resin Material

The electroless plating method for a resin material according to the present invention includes (1) bringing the surface to be treated of the resin material into contact with a pretreatment composition (step 1), and (2) bringing the surface to be treated of the resin material into contact with an electroless plating solution (step 2), and the pretreatment composition contains 10 mg/L or more of manganese ions and 10 mg/L or more of monovalent silver ions.

Step 1

Step 1 in the electroless plating method for a resin material according to the present invention is identical to the step described as step 1 of the pretreatment method for electroless plating for a resin material above.

Step 2

Step 2 is a step of bringing the surface to be treated of the resin material into contact with an electroless plating solution.

The method for bringing the surface to be treated of the resin material into contact with an electroless plating solution is not particularly limited. The surface to be treated of the resin material may be brought into contact with an electroless plating solution by a known method. From the standpoint of much higher contact efficiency, the method is preferably one in which the surface to be treated of a resin material is immersed in an electroless plating solution.

The electroless plating solution is not particularly limited, and a known autocatalytic electroless plating solution may be used. The electroless plating solution includes electroless nickel plating solutions, electroless copper plating solutions, electroless cobalt plating solutions, electroless nickel-cobalt alloy plating solutions, and electroless gold plating solutions.

The electroless plating solution preferably contains a reducing agent that is catalytically active on silver. The reducing agent includes dimethylamine borane, formalin, glyoxylic acid, tetrahydroboric acid, and hydrazine.

The conditions under which the surface to be treated of a resin material is brought into contact with an electroless plating solution are not particularly limited. For example, when a resin material is immersed in an electroless plating solution, the liquid temperature of the electroless plating solution may be about 20 to 70° C., and the immersion time may be about 3 to 30 minutes.

The amount of the reducing agent in the electroless plating solution is not particularly limited, and is preferably about 0.01 to 100 g/L, and more preferably about 0.1 to 10 g/L. Setting the lower limit of the amount of the reducing agent within these ranges further improves the plating deposition performance, while setting the upper limit of the amount of the reducing agent within these ranges further improves the stability of the electroless plating bath.

In the electroless plating method according to the present invention, step 2 may be repeated two or more times as necessary. Repeating step 2 two or more times forms two or more layers of the electroless plating film.

The electroless plating method according to the present invention may include, before step 2, an activation treatment that uses an activation treatment solution containing a reducing agent and/or an organic acid in order to improve the deposition performance in electroless plating.

The reducing agent for use in the activation treatment is not particularly limited, and the reducing agent includes dimethylamine borane, formalin, glyoxylic acid, tetrahydroboric acid, hydrazine, hypophosphite, erythorbic acid, ascorbic acid, hydroxylamine sulfate, hydrogen peroxide, and glucose. Of these, from the standpoint of much higher plating deposition performance, dimethylamine borane, formalin, glyoxylic acid, tetrahydroboric acid, and hydrazine are preferable.

One kind of such reducing agents may be used alone, or two or more kinds of reducing agents may be used in combination.

The concentration of the reducing agent in the activation treatment solution is not particularly limited, and is preferably 0.1 to 500 g/L, more preferably about 1 to 50 g/L, and still more preferably 2 to 25 g/L.

The organic acid for use in the activation treatment is not particularly limited, and includes formic acid, oxalic acid, glycolic acid, tartaric acid, citric acid, maleic acid, acetic acid, propionic acid, malonic acid, succinic acid, lactic acid, malic acid, gluconic acid, glycine, alanine, aspartic acid, glutamic acid, iminodiacetic acid, nitrilotriacetic acid, and fumaric acid. Of these, from the standpoint of much higher plating deposition performance, formic acid, oxalic acid, glycolic acid, tartaric acid, citric acid, and maleic acid are preferable.

One kind of such organic acids may be used alone, or two or more kinds of organic acids may be used in combination.

The concentration of the organic acid in the activation treatment solution is not particularly limited, and is preferably 0.1 to 500 g/L, more preferably about 1 to 50 g/L, and still more preferably 2 to 25 g/L.

The activation treatment method is not particularly limited. For example, a resin material that has been pretreated in step 1 described above may be immersed in an activation treatment solution with a liquid temperature of about 15 to 50° C. for about a few seconds to 10 minutes.

The electroless plating method for a resin material according to the present invention may further include, after step 2, an electroplating step.

The electroplating step may include optionally performing an activation treatment with an aqueous solution, such as of an acid or an alkali after step 2, and then immersing the resin material in an electroplating solution to perform electroplating.

The electroplating solution is not particularly limited, and can be suitably selected from known electroplating solutions depending on the purpose.

The electroplating method is not particularly limited. For example, the resin material on which an electroless plating film has been formed in step 2 may be immersed in an activation treatment solution with a liquid temperature of about 15 to 50° C. at a current density of about 0.1 to 10 A/dm$^2$ for about a few seconds to 10 minutes.

EXAMPLES

The following describes the present invention in more detail with reference to Examples and Comparative Examples. However, the present invention is not limited to these Examples.

Preparation of Electroless Plating Film

A flat plate (10 cm×5 cm×0.3 cm, surface area: about 1 dm$^2$) of ABS resin (manufactured by UMG ABS, tradename: UMG ABS3001 M) was prepared as a resin material (an object to be plated), and an electroless plating film was formed in accordance with the following method.

First, the resin material was immersed in an alkaline degreasing solution (manufactured by Okuno Chemical Industries Co., Ltd, Ace Clean A-220 bath) at 40° C. for 5 minutes, and washed with water.

Subsequently, components were added to water (a solvent) in accordance with the formulations shown in Tables 1 and 2 to prepare pretreatment compositions of the Examples and Comparative Examples. The resin material after being washed with water was immersed in the individual, prepared pretreatment compositions (immersion temperature: 68° C., and immersion time: 30 minutes).

Finally, the resin material was immersed in individual electroless plating solutions prepared by adding components to water (a solvent) in accordance with the formulations shown in Tables 1 and 2 at 40° C. for 10 minutes, thereby forming an electroless plating film.

TABLE 1

| | | Example 1 | Example 2 | Example 3 | Example 4 | Example 5 |
|---|---|---|---|---|---|---|
| Pretreatment Composition | Manganese (II) Sulfate (g/L) | 0 | 10 | 0 | 20 | 15 |
| | Manganese (III) Phosphate (g/L) | 0 | 0 | 8 | 0 | 2 |
| | Manganese (IV) Oxide (g/L) | 0 | 0 | 0 | 10 | 1 |
| | Sodium Permanganate (VII) (g/L) | 1.5 | 2 | 0 | 0 | 1 |
| | Sulfuric Acid (g/L) | 780 | 780 | 0 | 0 | 1100 |
| | Phosphoric Acid (g/L) | 0 | 200 | 0 | 780 | 100 |
| | Methanesulfonic Acid (g/L) | 380 | 200 | 1000 | 0 | 0 |
| | Silver Nitrate (g/L) | 3.4 | 0 | 5 | 0 | 0.02 |
| | Silver Sulfate (g/L) | 0 | 15 | 10 | 0.09 | 0 |
| | Manganese Ion Content (mg/L) | 580 | 4410 | 1465 | 13590 | 6840 |
| | Ag (I) Ion Content (mg/L) | 2160 | 10380 | 10095 | 62 | 13 |
| | pH | <1 | <1 | <1 | <1 | <1 |
| Electroless Plating Bath | Nickel Sulphate Hexahydrate (g/L) | 40 | 40 | 0 | 0 | 40 |
| | Sodium Acetate (g/L) | 10 | 10 | 0 | 0 | 10 |
| | Sodium Citrate (g/L) | 10 | 10 | 0 | 0 | 10 |
| | Copper Sulfate Pentahydrate (g/L) | 0 | 0 | 15 | 15 | 0 |
| | Sodium Hydroxide (g/L) | 0 | 0 | 10 | 10 | 0 |
| | EDTA (g/L) | 0 | 0 | 20 | 20 | 0 |
| | Dimethylamine Borane (g/L) | 4 | 3 | 0 | 0 | 3 |
| | Formaldehyde (g/L) | 0 | 0 | 5 | 10 | 0 |
| | Sodium Hypophosphite (g/L) | 0 | 0 | 0 | 0 | 10 |

TABLE 2

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Pretreatment Composition | Manganese (II) Sulfate (g/L) | 0 | 0 | 15 | 0.7 | 0 | 0 | 15 |
| | Manganese (III) Phosphate (g/L) | 0 | 0 | 2 | 0.8 | 0 | 0 | 2 |
| | Manganese (IV) Oxide (g/L) | 0 | 0 | 0 | 0 | 0 | 0 | 0 |

TABLE 2-continued

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| | Sodium Permanganate (VII) (g/L) | 0 | 0.001 | 2 | 0 | 1.5 | 1.5 | 2 |
| | Sulfuric Acid (g/L) | 0 | 780 | 1200 | 780 | 780 | 780 | 1200 |
| | Phosphoric Acid (g/L) | 800 | 0 | 0 | 0 | 0 | 0 | 0 |
| | Methanesulfonic Acid (g/L) | 0 | 100 | 0 | 0 | 380 | 380 | 0 |
| | Silver Nitrate (g/L) | 15 | 0 | 0.01 | 0 | 0 | 0 | 0 |
| | Silver Sulfate (g/L) | 0 | 5 | 0 | 0.001 | 0 | 0 | 0.01 |
| | Palladium Sulfate (mg/L) | 0 | 0 | 0 | 0 | 95 | 38 | 0 |
| | Manganese Ion Content (mg/L) | 0 | 0.4 | 6590 | 400 | 580 | 580 | 6590 |
| | Ag (I) Ion Content (mg/L) | 9520 | 3460 | 6 | 0.7 | 0 | 0 | 6 |
| | Pd (II) Ion Content (mg/L) | 0 | 0 | 0 | 0 | 50 | 20 | 0 |
| | pH | <1 | <1 | <1 | <1 | <1 | <1 | <1 |
| Electroless Plating Bath | Nickel Sulphate Hexahydrate (g/L) | 40 | 40 | 40 | 0 | 40 | 40 | 40 |
| | Sodium Acetate (g/L) | 10 | 10 | 10 | 0 | 10 | 10 | 10 |
| | Sodium Citrate (g/L) | 10 | 10 | 10 | 0 | 10 | 10 | 10 |
| | Copper Sulfate Pentahydrate (g/L) | 0 | 0 | 0 | 15 | 0 | 0 | 0 |
| | Sodium Hydroxide (g/L) | 0 | 0 | 0 | 10 | 0 | 0 | 0 |
| | EDTA (g/L) | 0 | 0 | 0 | 20 | 0 | 0 | 0 |
| | Dimethylamine Borane (g/L) | 3 | 4 | 3 | 0 | 4 | 4 | 3 |
| | Formaldehyde (g/L) | 0 | 0 | 0 | 5 | 0 | 0 | 0 |
| | Sodium Hypophosphite (g/L) | 0 | 0 | 10 | 0 | 0 | 0 | 10 |

The deposit percentage and adhesion of the plating films formed by the method described above were evaluated in accordance with the following methods.

(1) Deposit Percentage

The percentage of the area of the electroless plating film on the surface of the resin material was evaluated as a deposit percentage. A full coverage of the surface of the resin material was taken as a deposit percentage of 100%.

(2) Peel Strength Measurement

The resin material having an electroless plating film formed thereon was immersed in a copper sulfate plating bath, and subjected to electroplating treatment at a current density of 3 A/dm$^2$ at a temperature of 25° C. for 120 minutes to form a copper plating film, thereby preparing a sample. The sample was dried at 80° C. for 120 minutes and allowed to stand until being cooled to room temperature. Subsequently, a 10-mm-width cut was made on the plating film, and the plating film was pulled in a perpendicular direction to the surface of the resin material with a tensile tester (manufactured by Shimadzu Corporation, autograph AGS-J 1 kN), thereby measuring peel strength. Table 3 illustrates the results.

TABLE 3

| | Deposit Percentage (%) | Peel Strength (N/cm) |
|---|---|---|
| Example 1 | 100 | 13.1 |
| Example 2 | 100 | 12.8 |
| Example 3 | 100 | 10.5 |
| Example 4 | 100 | 10.1 |
| Example 5 | 100 | 10.9 |
| Comparative Example 1 | 100 | 1.0 or less |
| Comparative Example 2 | 100 | 2.1 |

TABLE 3-continued

| | Deposit Percentage (%) | Peel Strength (N/cm) |
|---|---|---|
| Comparative Example 3 | 85 | 10.2 |
| Comparative Example 4 | 25 | Unmeasurable |
| Comparative Example 5 | 100 | 6.5 |
| Comparative Example 6 | 80 | 7.1 |
| Comparative Example 7 | 95 | 10.2 |

The results shown in Table 3 reveal that plating films formed by immersing the resin material in the pretreatment compositions containing 10 mg/L or more of manganese ions and 10 mg/L or more of monovalent silver ions of Examples 1 to 5 and then immersing the resin material in an electroless plating solution exhibit a high deposit percentage and excellent adhesion.

Additionally, plating films formed by immersing the resin material in the pretreatment compositions of Examples 1 to 5 and then immersing the resin material in an electroless plating solution were confirmed to not require adding a catalyst in a separate catalyst-adding step to enhance the deposit percentage, because the films were fully covered with a deposit percentage of 100%. Thus, the use of the pretreatment composition for electroless plating according to the present invention was confirmed to reduce the adhesion of a catalyst on the surface of a jig used in forming an electroless plating film, thereby reducing the deposition of the plating film on the surface of the jig. This reduces the unevenness of the electroless plating film on the surface of the resin material because, when forming an electroless plating film using a jig repeatedly, the plating film deposited on the surface of the jig is exfoliated in the form of granules, and then incorporated into the electroless plating film on the surface of the resin material in each step.

Typically, when pretreatment is performed on a resin material by etching treatment with chromic acid, and an electroless plating catalyst is added using a colloid solution containing a tin compound, a palladium compound etc., chromic acid works as catalyst poison to reduce the adhesion of the catalyst onto the surface of a jig, thereby reducing the deposition of the plating film on the surface of the jig. However, when chromic acid is not used for environmental consideration, for example, the electroless plating film formed on the surface of the resin material becomes uneven due to the deposition of the plating film on the jig.

In contrast, a plating film formed by immersing a resin material in the pretreatment composition according to the present invention and then immersing the resin material in an electroless plating solution is fully covered with a deposit percentage of 100%; thus, it is unnecessary to separately add a catalyst in a catalyst-adding step to increase the deposit percentage. This reduces the adhesion of a catalyst on the surface of a jig used in forming an electroless plating film, the deposition of the plating film on the surface of the jig, and the unevenness of the electroless plating film formed on the surface of the resin material.

The use of the pretreatment composition free from manganese ions of Comparative Example 1 or the pretreatment composition with a septivalent manganese concentration of less than 10 mg/L of Comparative Example 2 resulted in low adhesion of the plating film.

The use of the pretreatment composition with a monovalent-silver-ion concentration of less than 10 mg/L of Comparative Example 3 or 4 resulted in a plating film with a lower deposit percentage.

The use of the pretreatment composition containing 50 mg/L of divalent palladium ions, instead of monovalent silver ions, of Comparative Example 5 resulted in a plating film with lower adhesion, although the deposit percentage of the plating film was not decreased. The use of the pretreatment composition containing 20 mg/L of divalent palladium ions of Comparative Example 6 resulted in a plating film with a deposit percentage lower than that of Comparative Example 5, although the adhesion of the plating film was decreased less than that of Comparative Example 5.

Additionally, a comparison between Comparative Examples 3 and 7 reveals that the use of silver(I) sulfate as a silver salt for adding monovalent silver ions further increases the deposit percentage of the plating film.

The invention claimed is:

1. A electroless plating method for pretreating a resin material, the method comprising (1) step 1: bringing the surface to be treated of the resin material into contact with a pretreatment composition, and (2) step 2: bringing the surface to be treated of the resin material into contact with an electroless plating solution, wherein the pretreatment composition contains 10 mg/L or more of manganese ions and 10 mg/L or more of monovalent silver ions, and the pretreatment composition has a pH of 2 or less, the method not comprising a catalyst-adding step.

2. The electroless plating method according to claim 1, wherein the electroless plating solution contains a reducing agent that is catalytically active on silver.

3. The electroless plating method according to claim 1, wherein manganese of the manganese ions has a valence of 3 or more.

4. The electroless plating method according to claim 2, wherein manganese of the manganese ions has a valence of 3 or more.

5. The electroless plating method according to claim 1, wherein a silver salt for adding the monovalent silver ions is at least one member selected from the group consisting of silver(I) sulfate, and silver(I) nitrate.

6. The electroless plating method according to claim 1, further comprising a post-treatment step between the step 1 and the step 2, using a post-treatment solution containing an inorganic acid solution consisting of hydrochloric acid, sulfuric acid, nitric acid, phosphoric acid, hydrofluoric acid, boric acid or a combination thereof.

7. The electroless plating method according to claim 1, wherein the resin material is formed of an acrylonitrile-butadiene-styrene copolymer resin (ABS resin) or a polymer alloy of a styrene based-resin with a polycarbonate (PC) resin.

8. The electroless plating method according to claim 1, wherein the pretreatment composition does not contain chromic acid.

9. The electroless plating method according to claim 1, wherein the manganese ions are manganese ions of divalent manganese and at least one member selected from the group consisting of permanganate ions, trivalent manganese ions, and quadrivalent manganese ions.

10. The electroless plating method according to claim 1, wherein the electroless plating solution contains a reducing agent that is catalytically active on silver.

11. The electroless plating method according to claim 1, wherein the pretreatment composition contains 0.01 to 100 g/L of a cationic polymer.

* * * * *